US006428248B1

(12) United States Patent
Lee

(10) Patent No.: US 6,428,248 B1
(45) Date of Patent: Aug. 6, 2002

(54) PUNCH FOR PRODUCTION DECORATIVE CUTOUTS

(76) Inventor: Cheng-Ho Lee, No. 74, Paokao Rd., Hsintien City, Taipei Hsien (TW)

( * ) Notice: Subject to any disclaimer, the term of this patent is extended or adjusted under 35 U.S.C. 154(b) by 72 days.

(21) Appl. No.: 09/619,452

(22) Filed: Jul. 19, 2000

(51) Int. Cl.[7] ..... B26F 1/02

(52) U.S. Cl. ..... 407/117; 407/120; 83/128; 83/633

(58) Field of Search ..... 83/683, 128, 633, 83/686, 621, 588; 407/113, 114, 115, 116, 117

(56) References Cited

U.S. PATENT DOCUMENTS 5,193,279 A * 3/1993 Pierce ..... 30/305
5,611,254 A * 3/1997 Rall ..... 83/467.1
5,749,278 A * 5/1998 Lee et al. ..... 83/588
5,778,748 A * 7/1998 Beijen ..... 83/529
5,974,929 A * 11/1999 Kugel et al. ..... 83/582
6,089,137 A * 7/2000 Lee ..... 83/621

* cited by examiner

*Primary Examiner*—Henry Tsai
(74) *Attorney, Agent, or Firm*—Jackson Walker L.L.P.

(57) ABSTRACT

A punch for producing decorative cutouts includes a base with a die secured thereto, a cutter mounted above the die and urgeable downward therethrough by a lever pivotally secured to the base, at least one spring compressed between the base and an under face of the cutter, and an ejector mounted in an upper face of the die. The cutter includes an inner leading edge, an outer trailing edge, an inclined periphery extending between the inner and outer edges, and at least one central cutting edge. The die has an outer profile configured to mate with the edges of the cutter, and at least one inner profile configured to mate with the central cutting edge. An ejector is mounted in a recess surrounding the outer profile of the die, whereby cutouts are ejected efficiently from the punch.

7 Claims, 5 Drawing Sheets

PUNCH FOR PRODUCTION DECORATIVE CUTOUTS

BACKGROUND OF THE INVENTION

1. Field of the Invention

The invention relates to an improved punch for producing decorative cutouts, and more particularly a paper punch which cuts clearly and smoothly multiple peripheries of a desired decorative cutout.

2. Description of Related Art

Paper punches are used to produce cutouts with attractive shapes which can be used on special occasions, such as confetti at weddings. Simple shapes with only an outer periphery have become commonplace and lost their novelty to consumers, so more intricate shapes with multiple peripheries are produced by advanced paper punches. Such punches include a female die, and a male cutter with at least two continuous blades formed along a single plane. However, when the punch is operated it is found that after the paper has been cut by a lower one of the blades, the paper is not properly held in place and becomes crinkled and damaged as the second blade penetrates it. Accordingly, the resulting cutout does not have a satisfactory appearance and lacks commercial viability. Furthermore, it is found that the paper cutouts are not satisfactorily ejected every time from the punch which then becomes clogged, leading to frustration and time lost.

Thus there is a long and unfulfilled need for an improved punch which can produce intricate paper cutouts with clearly cut peripheries, and which are ejected efficiently from the punch after completion of the cutting operation.

SUMMARY OF THF INVENTION

The main objective of the invention is to provide an improved punch which produces intricate cutouts with clearly cut peripheries. A further objective is to provide an improved punch from which cutouts are ejected efficiently after completion of every punching operation. The punch includes a female die defining an intricate profile, and a male cutter mated with the female die to produce a paper cutout with multiple peripheries. A resilient ejector mounted in the punch is compressed by the downward moving male cutter and resistance of the paper until the perforation process is complete, whereafter the ejector resumes its non-compressed state and ejects the cutout from the punch.

Other objects, advantages and novel features of the invention will become more apparent from the following detailed description when taken in conjunction with the accompanying drawings.

DETAILED DESCRIPTION OF THE PREFERRED EMBODIMENT

Figure 1:
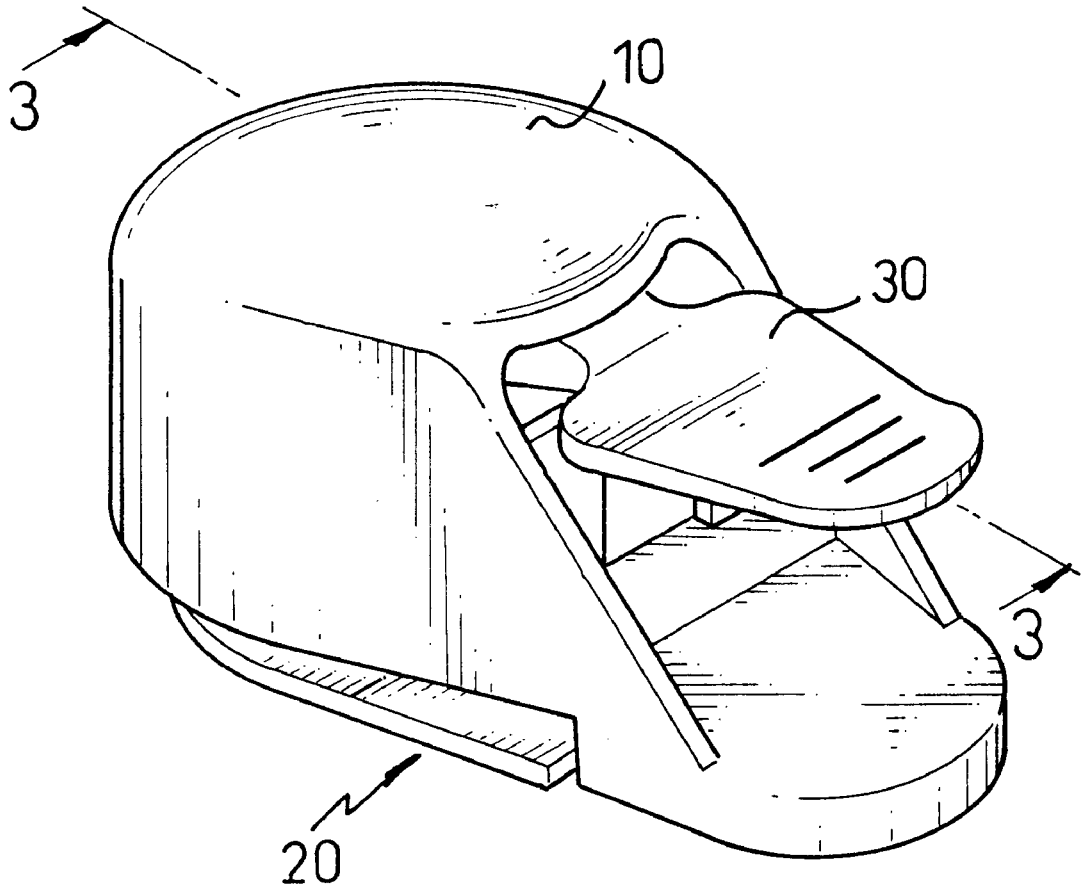
FIG. 1 is a top perspective view of an improved punch for producing decorative cutouts in accordance with the present invention.
Figure 2:
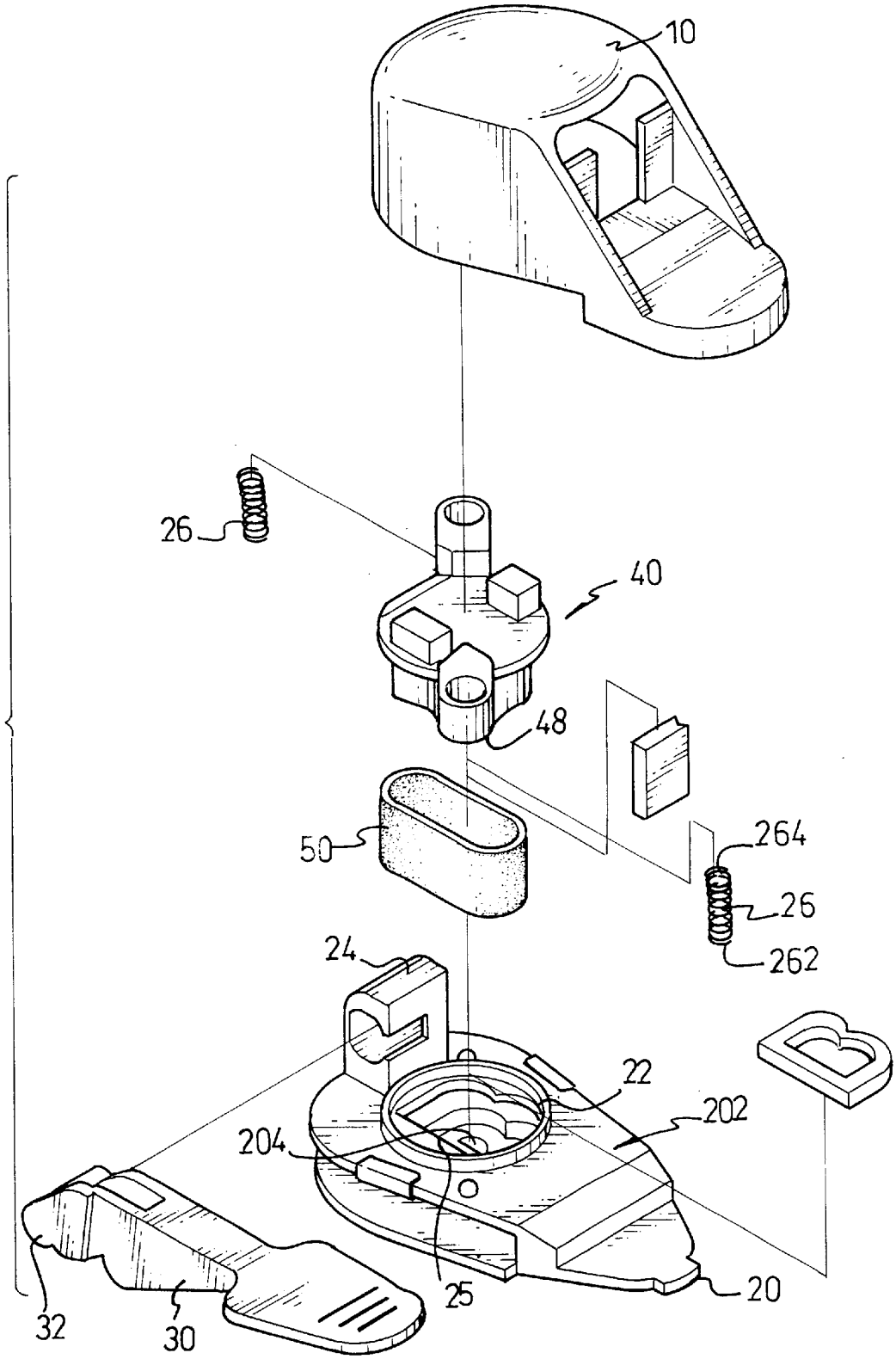
FIG. 2 is an exploded perspective view of the punch shown in FIG. 1.

Referring to FIGS. 1 and 2, an improved punch for producing decorative cutouts of the present invention comprises a housing (10), a base (20), a lever (30), a male cutter (40), and a resilient ejector (50). The base (20) includes a female die (22) secured to a central portion of a top periphery (202) of the base (20), and a pivot block (24) at one end of the top periphery (202) in which one end (32) of the lever (30) is pivotally received. The female die (22) defines a shape with an outer profile and at least one inner profile in communication with an exit (204) defined in the base (20). The housing (10) is fitted to the top periphery (202) of the base (20) and encloses the female die (22), the male cutter (40), and part of the lever (30). A remaining part of the lever (30) protrudes from the housing (10) for a user to press down to perform a perforation process.

Figure 5:
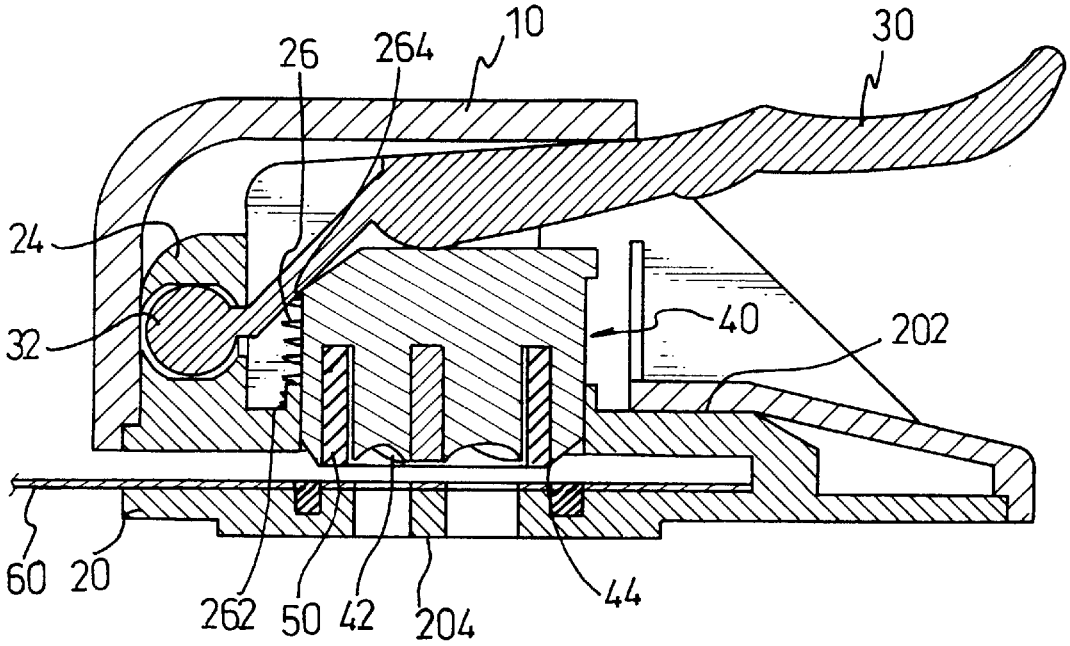
FIG. 5 is a third cross-sectional view of the punch of FIG. 1 taken along the line 3—3 therein, in a third mode.
Figure 3:
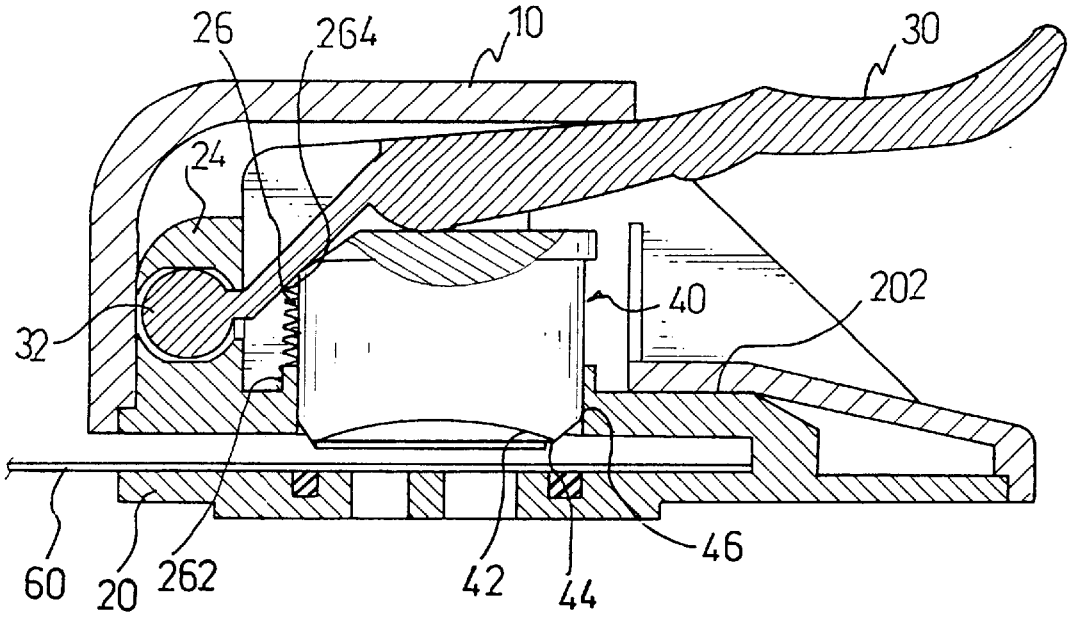
FIG. 3 is a cross-sectional view of the punch of FIG. 1 taken along the line 3—3 therein, in a first mode.
Figure 4:
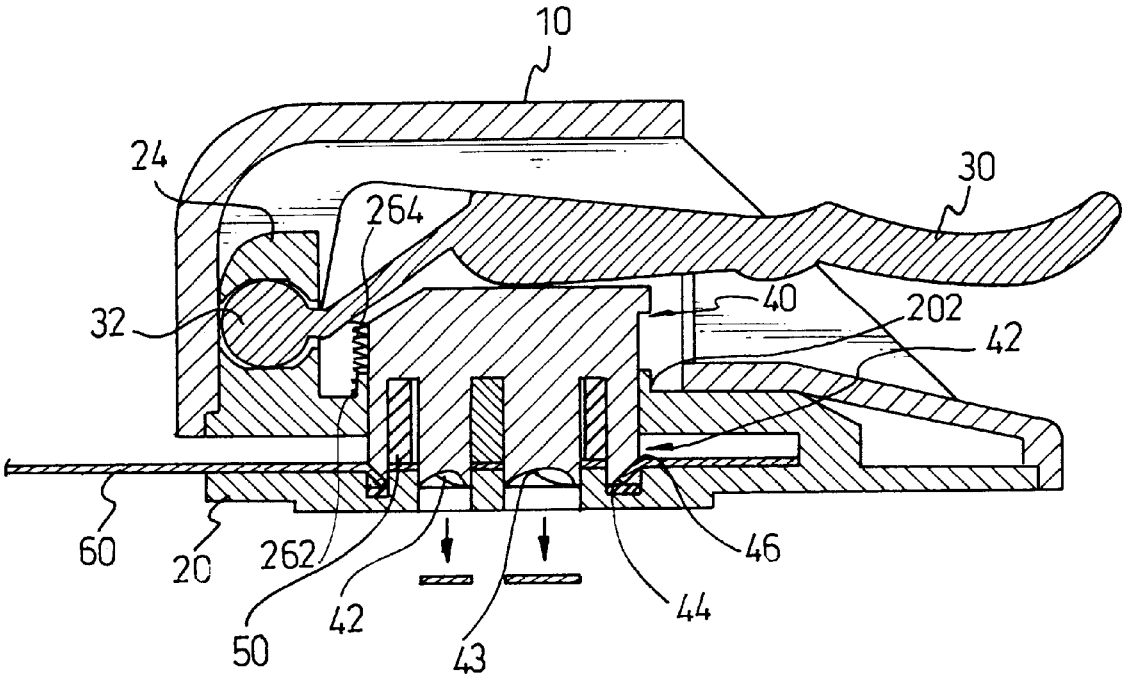
FIG. 4 is a second cross-sectional view of the punch of FIG. 1 taken along the line 3—3 therein, in a second mode.

Referring to FIGS. 3, 4 and 5, the male cutter (40) is securely mounted on the top periphery (202) of the base (20) and beneath the lever (30), and has a bottom face formed as a blade (42). The blade (42) has at least one central cutting edge (43) configured to mate with the inner profile of the die (22), a leading inner edge (44), a trailing outer edge (46), and an outwardly inclined periphery extending between the inner and outer edges (44, 46). The inner and outer edges (44, 46) are configured to mate with the outer profile of the die (22). The cutter (40) further has a top face against which the lever (30) abuts. Two springs (26) each have a bottom end (262) abutting the top periphery (202) of the base (20), and a top end (264) received in a respective one of two sockets (48), as shown in FIG. 2, defined in the bottom face of the cutter (40), and are always in a degree of compression. The springs (26) urge the cutter (40) and lever (30) upward away from the base (20) to maintain the paper punch in a preperforation mode as shown in FIG. 3.

Referring to FIGS. 3, 4, and 5 the resilient ejector (50), formed as a rubber loop, is received in a recess (25) surrounding the die (22), and is configured identical to the inner and outer edges (44, 46) of the blade (42). A sheet of paper (60) is inserted in a slot (not numbered) defined in the base (20), and between the die (22) and the cutter (40) suspended above the die (22). Although paper is the designated medium in this description, it is to be appreciated that any other suitable material can be cut.

Figure 6:
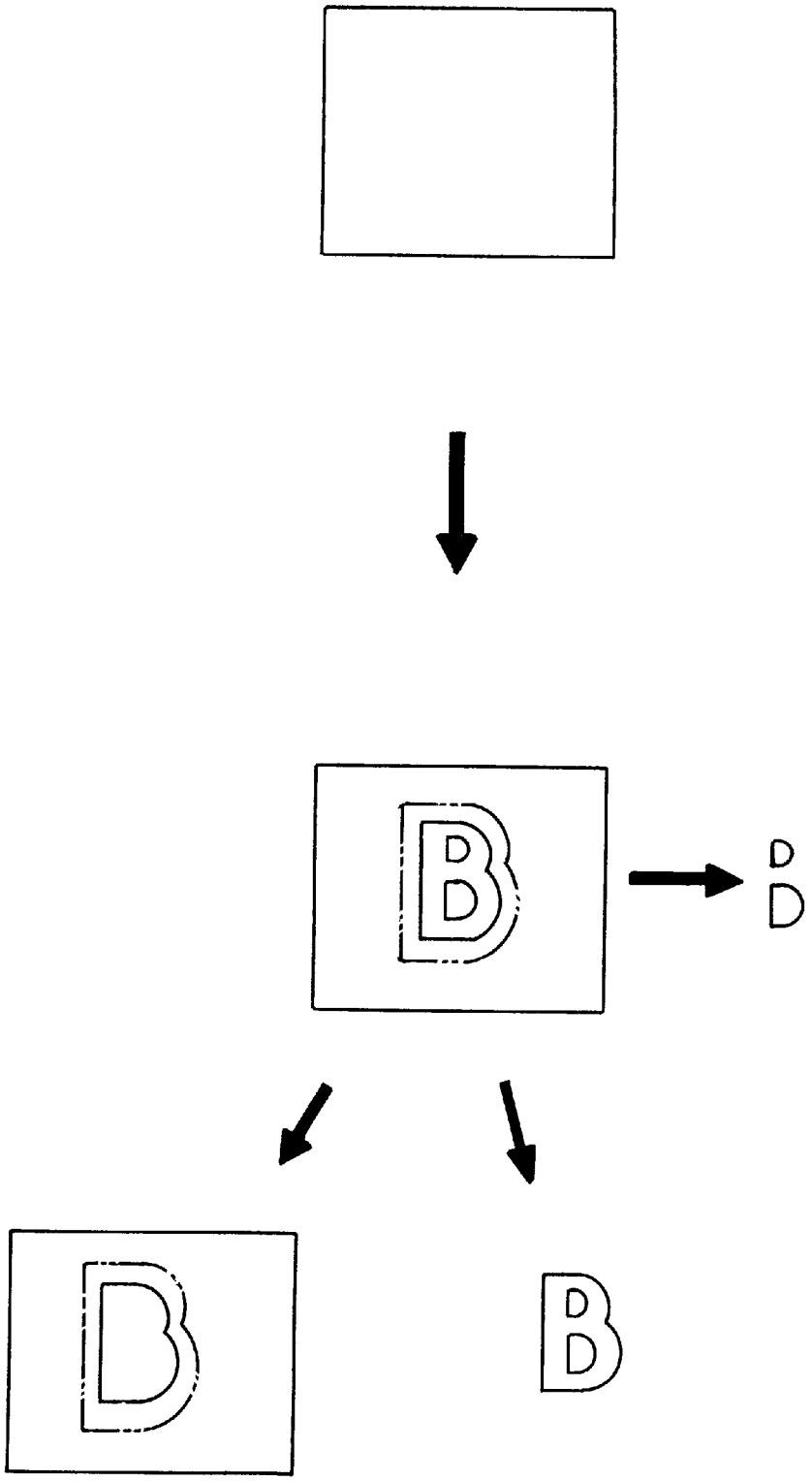
FIG. 6 is a perforation sequence of a cutout produced by the punch of FIG. 1.

Referring to FIGS. 2 and 6, the cutter (40) and die (22) mate to produce a cutout configured as a capital letter "B" but any configuration, especially configurations with inner and outer peripheries, can be produced according to respective cutters and dies employed.

During the perforation process as shown in FIG. 4, the cutter (40) is urged down into the die (30) via a user pushing the lever (30) down towards the base (20) and overcoming resilience of the springs (26), whereby the central cutting edge (43) and the leading inner edge (44) cut the paper (60), while the resilient ejector (50) slightly resists lateral movement of the paper (60).

As shown in FIG. 5, once the trailing edge (46) of the blade (40) has descended past a top face of the die (22) the perforation process is complete and the user releases the lever (30) which is then urged upward by the springs (26), whereafter the resilient ejector (50) urges the cut out from the die (30). Paper cut by the central cutting edge (43) is ejected from the punch via the exit (204).

The punch of the present invention has the following advantages:

1. a desired configuration can be perforated in a process where the material to be cut is held securely to enable cut peripheries to be clearly defined; and 2. the cutout produced by the perforation process is ejected efficiently by the ejector from the punch.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A punch whereby decorative cutouts with clearly cut peripheries can be produced from a perforation process, wherein the punch comprises:

a die defining an outer profile and at least one inner profile;

a cutter comprising an inner leading edge configured to mate with the outer profile of the die, an outer trailing edge, an inclined periphery extending between the inner and outer edges, and at least one central cutting edge configured to mate with the at least one inner profile of the die;

a resilient ejector formed as a loop and received in a recess surrounding the die, and configured to mate with the inner leading edge of the cutter, and having a top face equal in height to an upper face of the die; and means for combining the die and the cutter, whereby the cutter can reciprocally extend through the die;

the improvement residing in that after the central cutting edge and the leading inner edge have cut peripheries in a material , a remaining portion of the material is held in place by the resilient ejector until the trailing edge and the inclined periphery have descended past the upper face of the die to complete the perforation process.

2. The punch as claimed in claim 1, wherein the means for combining the die and cutter comprises:

a base wherein the die is securely mounted and the cutter is reciprocally mated with die;

a lever pivotably secured with the base to urge downward the cutter into the die; and a return device mounted on the base to return the cutter and lever from a post perforation position to a subsequent pre-perforation position.

3. The punch as claimed in claim 1 further comprising a housing to enclose the die, the cutter and the means for combining the die and cutter.

4. The punch as claimed in claim 2, wherein the return device comprises at least one compression spring disposed between the base and an under face of the cutter.

5. A punch for producing decorative cutouts, comprising:

a base;

a die secured in the base;

a cutter matingly reciprocable in a perforation process through the die;

an ejecting device received in an upper face of the die;

a lever pivotally secured to the base and with an under face abutting a top face of the cutter, whereby the cutter can be urged reciprocally downward into the die;

a return mechanism compressed between the base and the cutter, whereby the cutter is returnable to a subsequent pre-perforation process position; and a housing mounted to the base and enclosing the die, the cutter and the ejecting device, whereby when the cutouts are produced by the punch they are ejected efficiently therefrom by the ejecting device.

6. The punch as claimed in claim 5, wherein the ejecting device is a resilient loop.

7. The paper punch as claimed in claim 5, wherein the ejecting device is received in a recess configured around an outer periphery of the die, and has a top edge flush with the upper face of the die.

* * * * *